US012325944B2

(12) United States Patent
Rajendran et al.

(10) Patent No.: US 12,325,944 B2
(45) Date of Patent: Jun. 10, 2025

(54) CONTROLLING PROCESS AIR BYPASS AROUND THE DRUM IN COMBO WASH-DRY SYSTEM

(71) Applicant: Whirlpool Corporation, Benton Harbor, MI (US)

(72) Inventors: Arun Rajendran, Saint Joseph, MI (US); Roy Edward Masters, Jr., Saint Joseph, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

(21) Appl. No.: 18/510,895

(22) Filed: Nov. 16, 2023

(65) Prior Publication Data

US 2024/0084489 A1 Mar. 14, 2024

Related U.S. Application Data

(63) Continuation of application No. 17/140,369, filed on Jan. 4, 2021, now Pat. No. 11,846,059.

(51) Int. Cl.

| | |
|---|---|
| ***D06F 25/00*** | (2006.01) |
| ***D06F 37/22*** | (2006.01) |
| ***D06F 37/26*** | (2006.01) |

(52) U.S. Cl.

CPC ..... *D06F 25/00* (2013.01); *D06F 37/22* (2013.01); *D06F 37/267* (2013.01); *D06F 37/266* (2013.01)

(58) Field of Classification Search

CPC ..... D06F 25/00; D06F 37/22; D06F 37/266; D06F 37/267; D06F 58/04

See application file for complete search history.

(56) References Cited

U.S. PATENT DOCUMENTS

| | | | |
|---|---|---|---|
| 1,957,585 | A | 5/1934 | Gratian |
| 2,569,515 | A | 10/1951 | Collins |
| 2,864,394 | A | 12/1958 | Hempel |
| 3,066,695 | A | 12/1962 | Allen |
| 3,163,029 | A | 12/1964 | Jacobs |
| 3,247,690 | A | 4/1966 | Kahn |
| 3,584,650 | A | 6/1971 | Macaulay |
| 3,750,304 | A | 8/1973 | Ghadiall |
| 3,807,444 | A | 4/1974 | Fortune |

(Continued)

FOREIGN PATENT DOCUMENTS

| | | | |
|---|---|---|---|
| CN | 106283561 | A | 1/2017 |
| CN | 107558092 | A | 1/2018 |

(Continued)

OTHER PUBLICATIONS

European Search Report for EP21205375.5-1016, dated Mar. 22, 2022 (76 Pages).

(Continued)

*Primary Examiner* — Joseph L. Perrin

(74) *Attorney, Agent, or Firm* — Harness, Dickey & Pierce, PLC

(57) ABSTRACT

A combination washer/dryer machine has a rotatable drum inside a cabinet. The drum has an external surface. A tub is positioned inside the cabinet. The drum is rotatable in the tub. The tub has an inner surface. A seal extends between the exterior surface of the drum and the inner surface of the tub forming a desired gap during washing operations and the seal operates to minimize the bypass of drying air during drying operations.

13 Claims, 8 Drawing Sheets

(56) References Cited

U.S. PATENT DOCUMENTS

| | | | |
|---|---|---|---|
| 3,875,686 | A | 4/1975 | Smoot |
| 4,006,534 | A | 2/1977 | Coffman |
| 4,669,200 | A | 6/1987 | Carr |
| 4,835,882 | A | 6/1989 | Dongelmans |
| 5,325,892 | A | 7/1994 | Japuntich et al. |
| 5,469,883 | A | 11/1995 | Lee |
| 5,601,117 | A | 2/1997 | Lewis et al. |
| 6,006,445 | A | 12/1999 | Large |
| 6,796,150 | B2 | 9/2004 | Bringewatt et al. |
| 7,757,521 | B2 | 7/2010 | Hong |
| 8,499,473 | B2 | 8/2013 | Dal Ben et al. |
| 8,516,716 | B2 | 8/2013 | Dal Ben et al. |
| 9,580,856 | B1 | 2/2017 | Schurr |
| 9,970,705 | B2 | 5/2018 | Lowe |
| 10,066,336 | B2 | 9/2018 | Schurr |
| 10,196,772 | B2 | 2/2019 | Lee et al. |
| 2006/0005581 | A1 | 1/2006 | Banba |
| 2008/0223084 | A1 | 9/2008 | Kuwabara |
| 2010/0229607 | A1 | 9/2010 | Persson et al. |
| 2013/0174435 | A1 | 7/2013 | Rockwell et al. |
| 2015/0040417 | A1 | 2/2015 | Arcarons Alibes et al. |
| 2020/0270793 | A1 | 8/2020 | Kim et al. |

FOREIGN PATENT DOCUMENTS

| | | | |
|---|---|---|---|
| DE | 3929023 | C1 | 9/1990 |
| DE | 19828243 | A1 | 12/1999 |
| DE | 19907602 | A1 | 8/2000 |
| DE | 102008043348 | A1 | 5/2010 |
| EP | 1559825 | A1 | 8/2005 |
| EP | 1790768 | A2 | 5/2007 |
| EP | 2850239 | A1 | 3/2015 |
| EP | 3469135 | A1 | 4/2019 |
| EP | 3543393 | A2 | 9/2019 |
| EP | 3741898 | A1 | 11/2020 |
| EP | 3995615 | A1 | 5/2022 |
| GB | 2297588 | A | 8/1996 |
| JP | 03026293 | | 2/1991 |
| JP | 2004008683 | A | 1/2004 |
| JP | 2005304989 | A | 11/2005 |
| JP | 2006122697 | A | 5/2006 |
| JP | 2007061548 | A | 3/2007 |
| JP | 4444016 | B2 | 3/2010 |
| JP | 4541023 | B2 | 9/2010 |
| JP | 4945154 | B2 | 6/2012 |
| KR | 20050037187 | A | 4/2005 |
| KR | 100529954 | B1 | 11/2005 |
| KR | 100546613 | B1 | 1/2006 |
| WO | 2008148508 | A1 | 12/2008 |
| WO | 2009041345 | A1 | 4/2009 |
| WO | 2014181493 | A1 | 11/2014 |
| WO | 2016050295 | A1 | 4/2016 |
| WO | 2018093205 | A2 | 5/2018 |
| WO | 2018171526 | A1 | 9/2018 |

OTHER PUBLICATIONS

European Search Report for EP Application No. 22177103.3-1016, dated Dec. 2, 2022 (77 Pages).

European Search Report for EP21214203.08-1016, dated May 10, 2022 (78 Pages).

CONTROLLING PROCESS AIR BYPASS AROUND THE DRUM IN COMBO WASH-DRY SYSTEM

CROSS-REFERENCE TO RELATED APPLICATIONS

This is a continuation of U.S. patent application Ser. No. 17/140,369, which was filed on Jan. 4, 2021. The entire disclosure of the above application is incorporated herein by reference.

FIELD

The present disclosure relates to combination washer/dryer machines and, more particularly, to a combination washer/dryer machine with a seal sealing a gap formed between the drum and tub during washing and drying operations.

BACKGROUND

In combination washer/dryer machines, it is difficult to provide a drying cycle without a lengthy finishing drying time. Several reasons exist for the lengthy drying time of the clothes within the drum. One such reason is that a gap exists between the drum and the tub. The gap enables air to bypass the drum. Thus, the drying air exits the machine without providing its heated air to the clothes within the drum. Accordingly, the drying cycle is inefficient and necessitates a longer drying time.

It would be desirable to provide a combination washer/dryer machine with an efficient drying cycle time. It would also be desirable to utilize all of the created drying air and pass it into the drum for its intended drying purposes. Thus, it is desirable to eliminate bypasses around the drum. Drying air would be forced to enter into the drum. Accordingly, with all the drying air forced into the drum, this would, in turn, reduce the drying cycle time.

It is also desirable to provide a combination washer/dryer machine that overcomes the deficiencies of the prior art. It is desirable to provide a combination washer/dryer machine that provides a flow restriction to avoid air from bypassing the drum. Thus, it is desirable to move substantially all of the generated heated air to enter into the drum.

SUMMARY

In accordance with the present disclosure, a combination washer/dryer machine comprises a rotatable drum inside a cabinet. The drum has an external surface. A tub is positioned inside the cabinet. The drum is rotatable in the tub. The tub has an inner surface. A seal extends between the exterior surface of the drum and the inner surface of the tub to form a gap between the seal and the drum during washing operations. The seal functions to minimize the bypass of drying air around the drum during drying operations.

The seal includes an attachment portion and a flap. The flap is dynamic and moves in response to drying air entering the tub. The attachment portion is secured to the tub. In particular, a ring is positioned on the tub and the seal is positioned on the ring. The flap is configured to cover openings/apertures in the ring. Drying air enters the apertures in the ring, lifting the flap, which reduces the gap between the seal and the drum.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Figure 3:
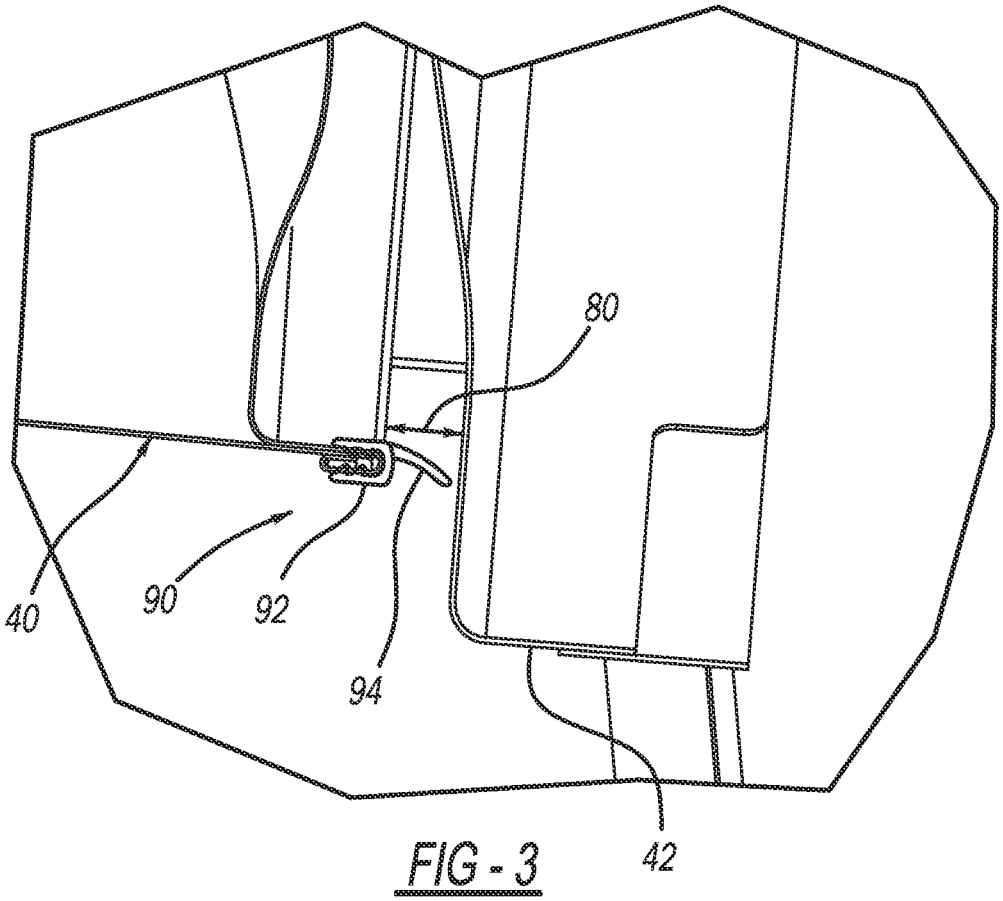
FIG. 3 is an enlarged cross-section view of FIG. 2.
Figures 4A, 4B, 4C:
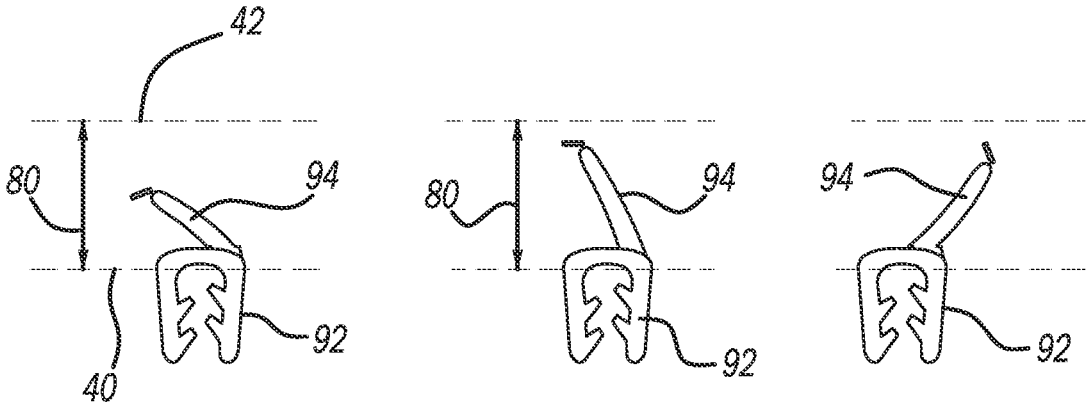
Figure 5:
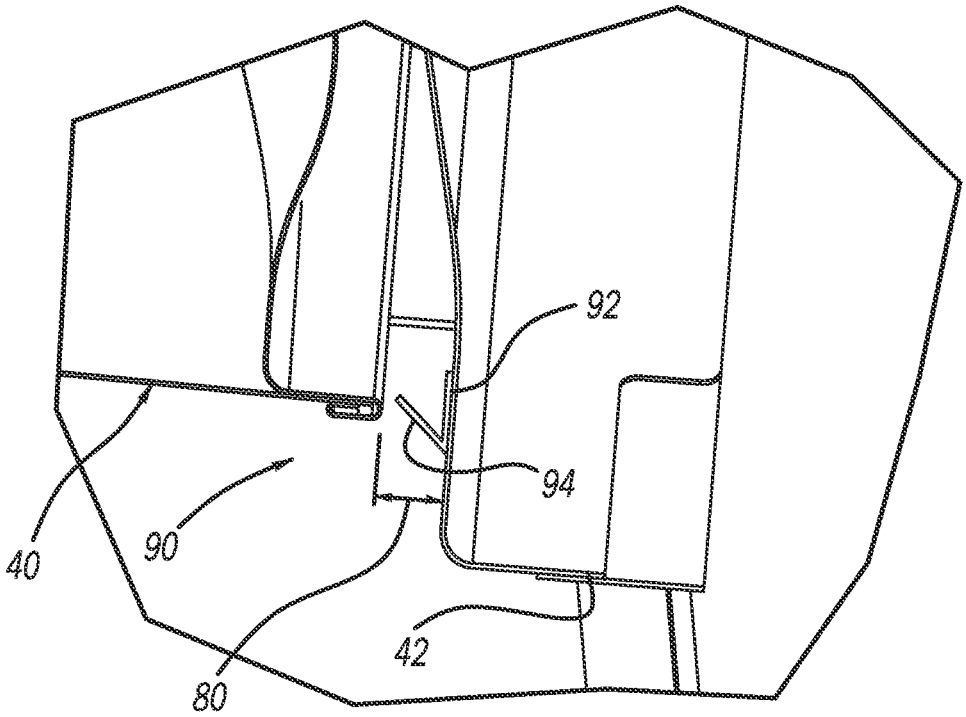
Figure 6:
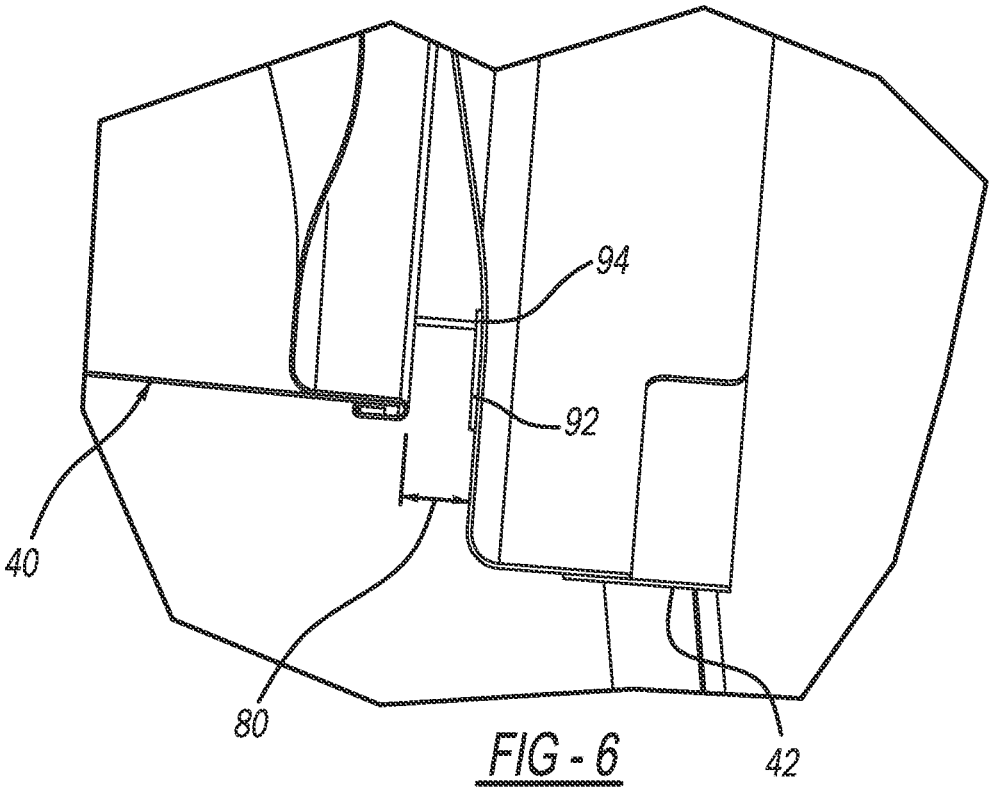
Figure 7:
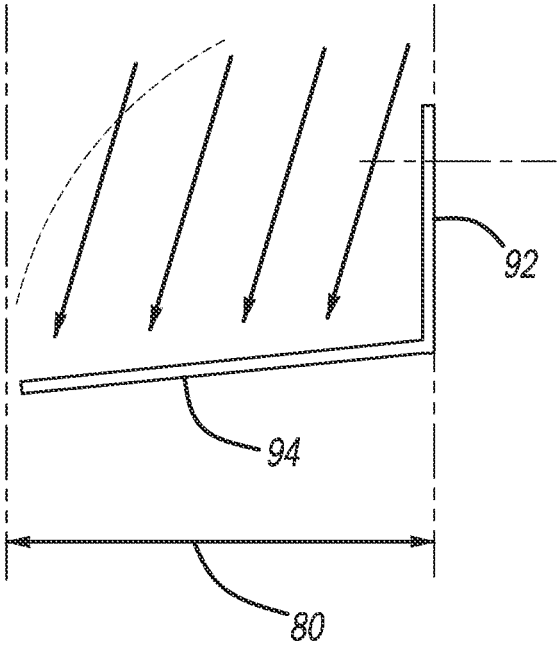
Figure 8:
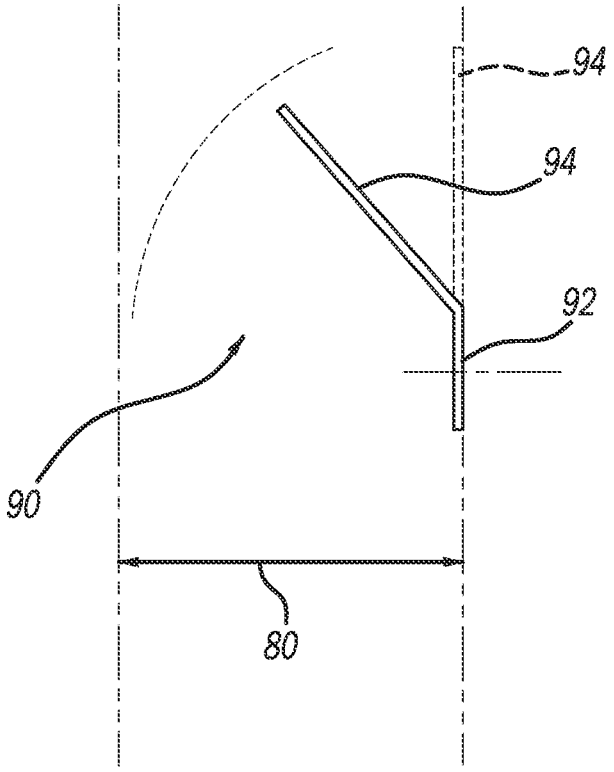
Figure 9:
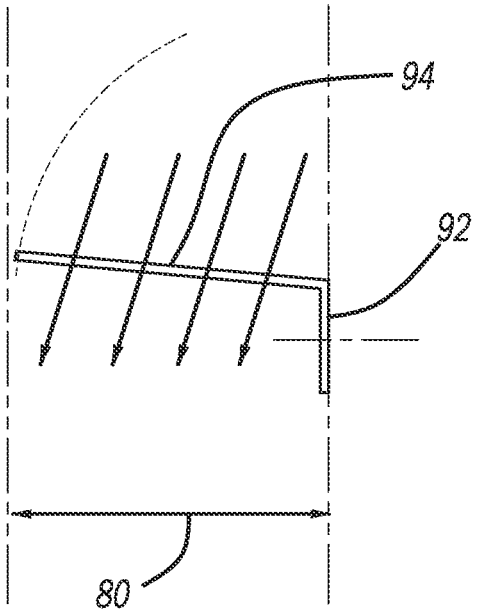
Figure 10:
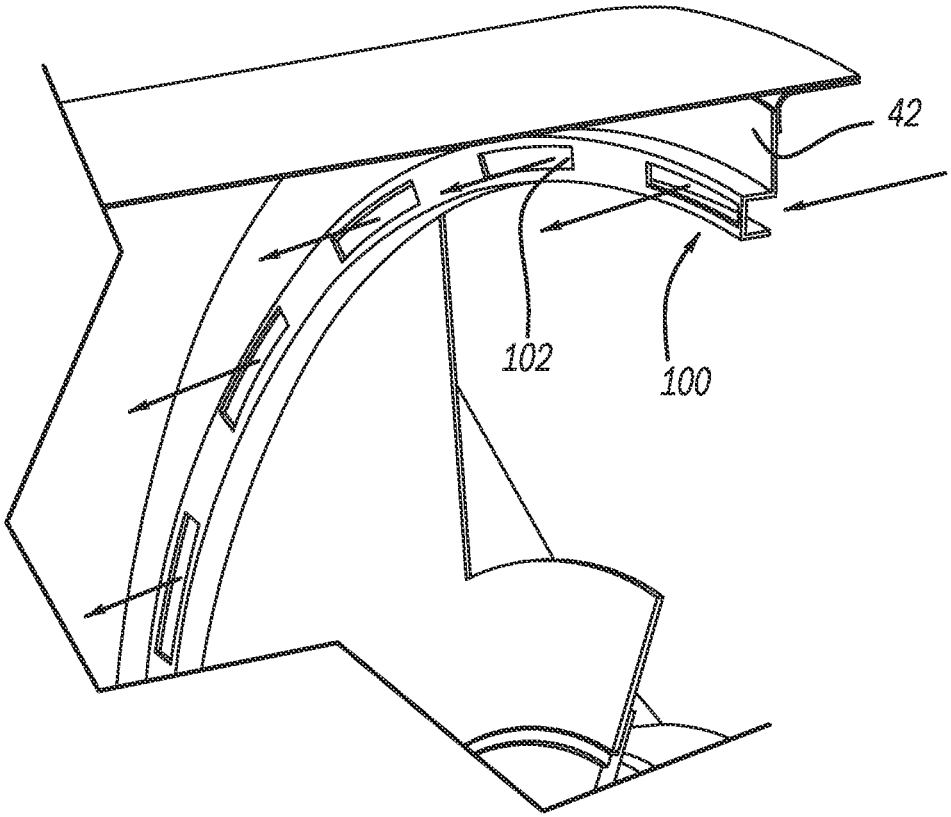
Figure 11:
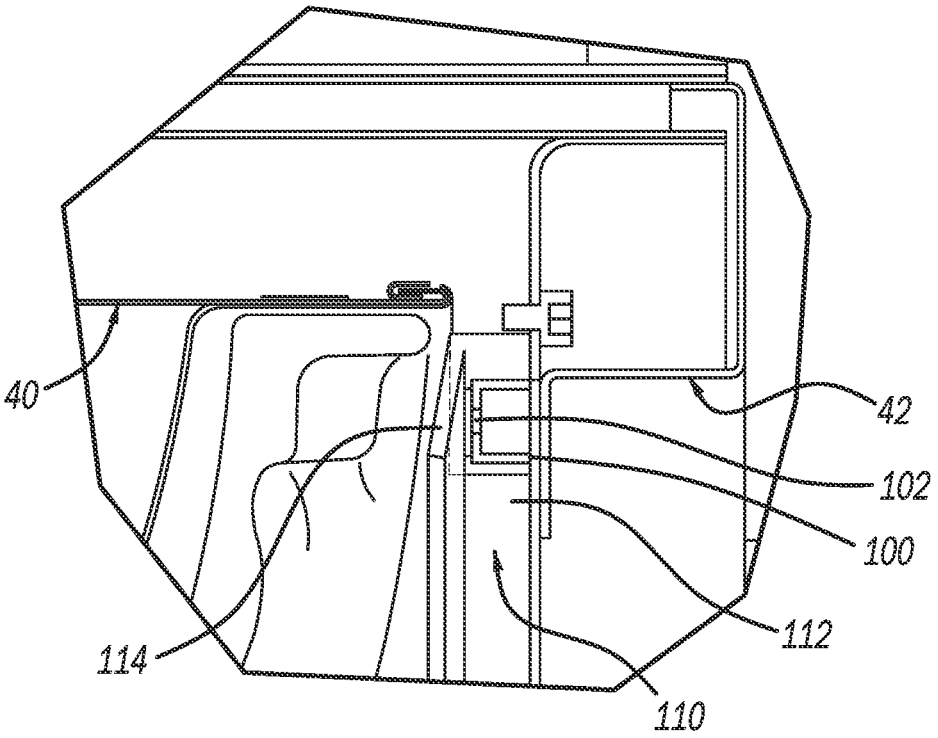
Figure 12:
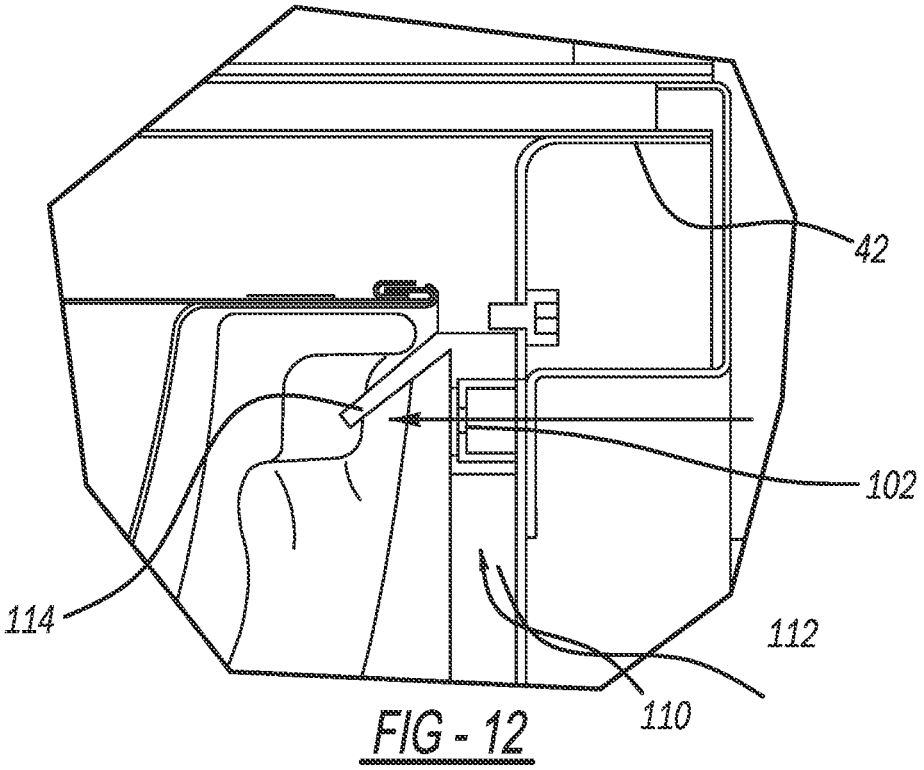

FIGS. 4A-C are cross-section views of the seal;

FIG. 5 is a cross-section view like FIG. 3 of an additional embodiment;

FIG. 6 is a cross-section view like FIG. 5 in a second position;

FIG. 7 is a cross-section view like FIG. 5 in an additional position;

FIG. 8 is a cross-section view of an additional embodiment;

FIG. 9 is a cross-section view like FIG. 8;

FIG. 10 is a perspective view of a ring on the tub;

FIG. 11 is a cross-section view of FIG. 10 with the seal present;

FIG. 12 is a cross-section view like FIG. 11 in a second position; and

Figure 13:
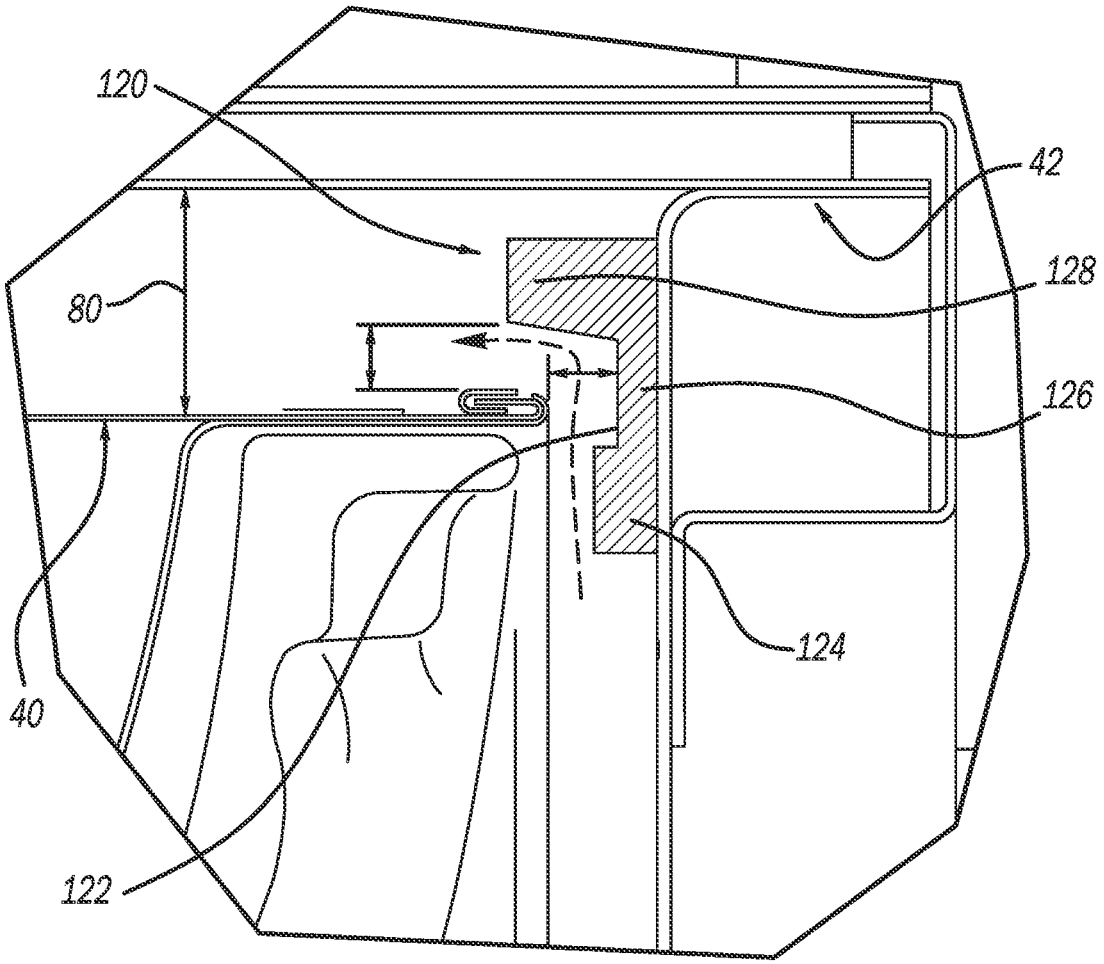

FIG. 13 is a cross-section view of another embodiment of the seal.

DETAILED DESCRIPTION

Example embodiments will now be described more fully with reference to the accompanying drawings.

Turning to the figures, a combination washer/dryer machine is illustrated and designated with the reference numeral 20. The combination washer/dryer machine 20 includes a cabinet 24 with a plurality of panels 26. The front panel 28 includes a door 30 to enable access into the combination washer/dryer machine 20. Controls 32 are positioned on the front panel 28. The controls 32 control the operation of the combination washer/dryer machine.

Figure 1:
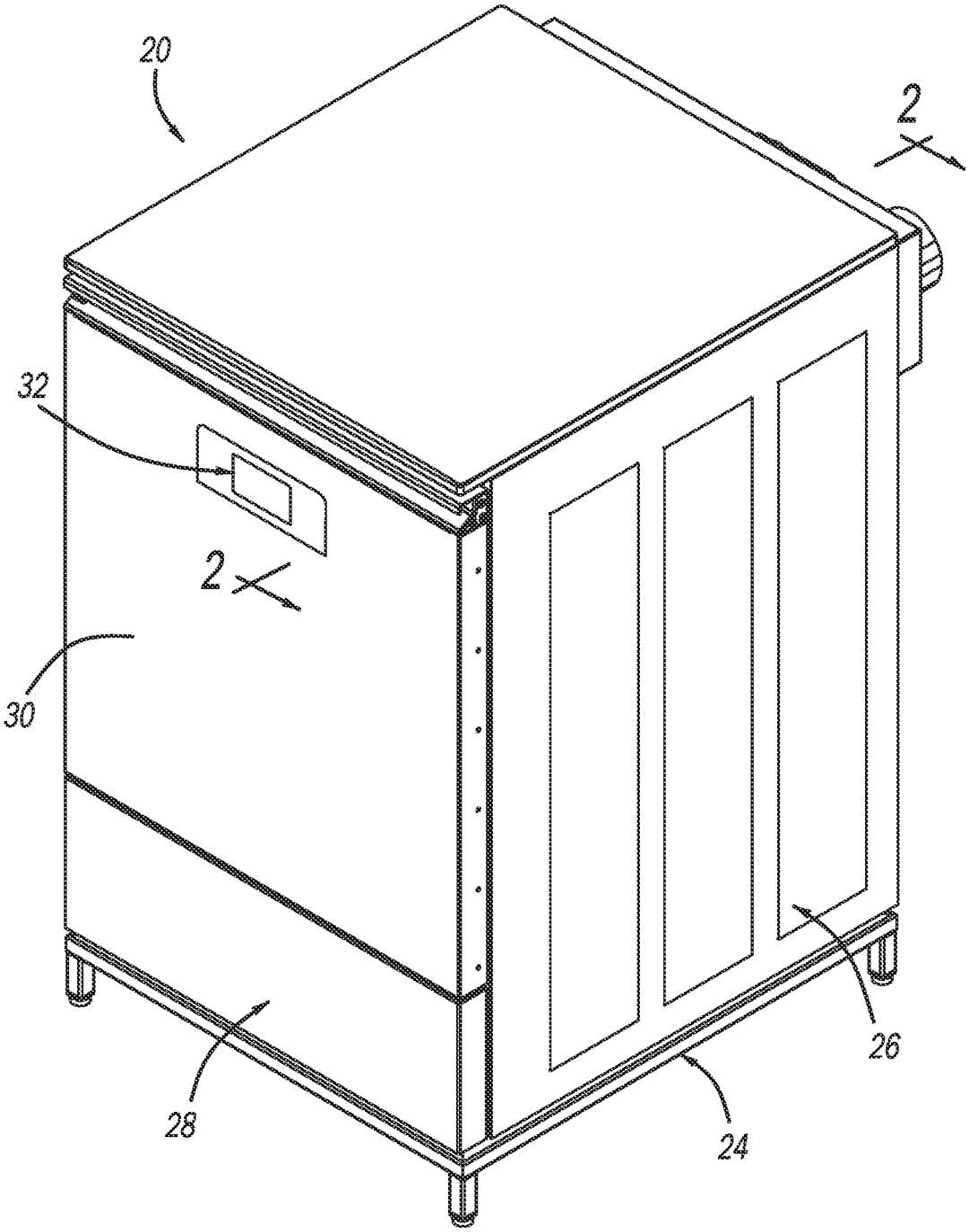
FIG. 1 is a perspective view of a combination washer/dryer machine in accordance with the disclosure.
Figure 2:
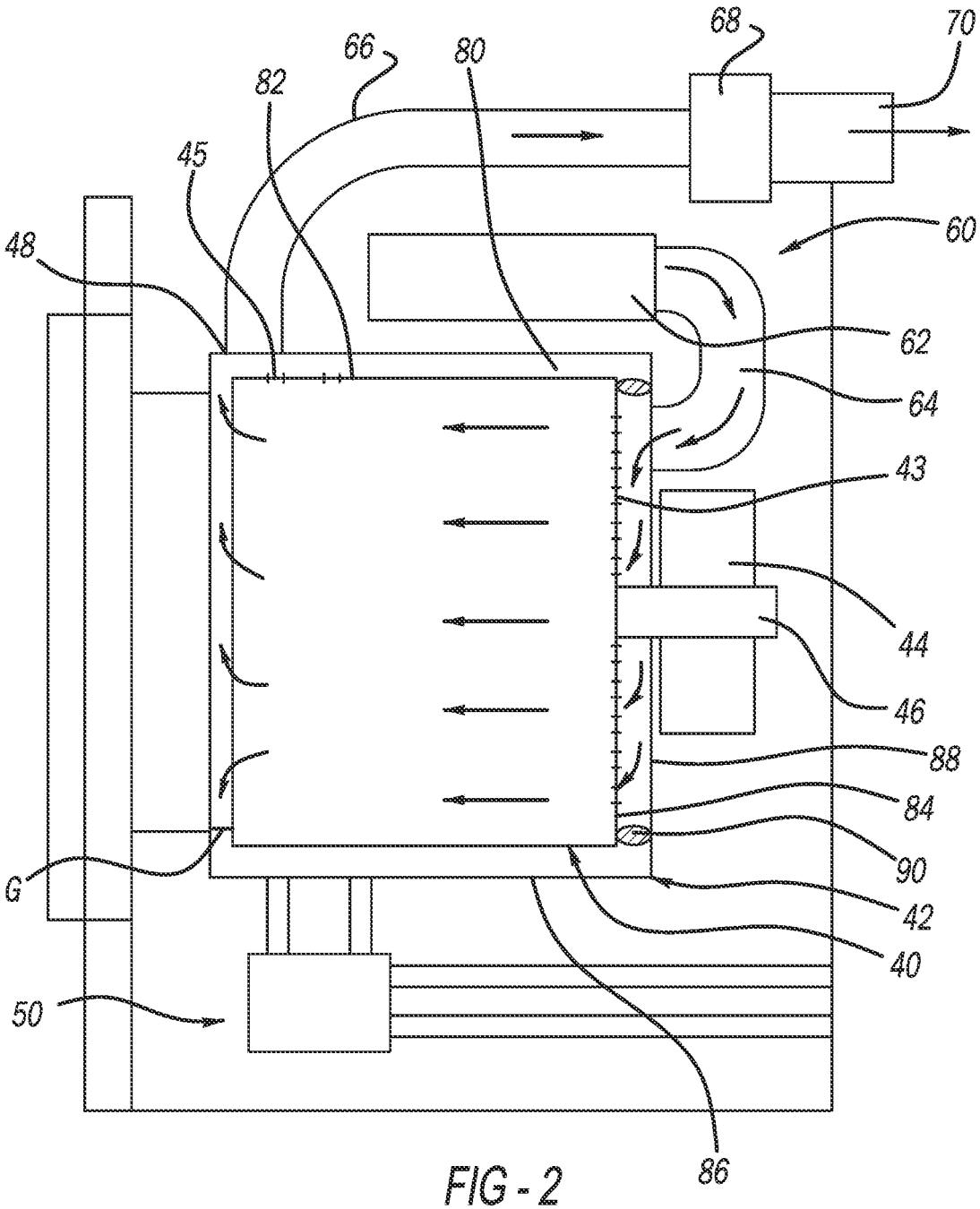
FIG. 2 is a schematic view in cross-section of the washer/dryer machine of FIG. 1.

Turning to FIG. 2, a cross-section view of the washer/dryer machine 20 is illustrated. The combination washer/dryer machine 20 includes a drum 40 rotationally positioned within a tub 42. The drum 40 is rotated via a motor 44 and a shaft 46. A conventional washing circuit 50 provides for washing of clothes within the drum 40. A conventional heating circuit 60 provides heat for drying the clothes within the drum 40. The heating circuit 60 includes a heater 62 with a conduit 64 passing heated air into the tub 42. The drum 40 includes apertures 43 in its end plate surface 84 that enable the heated air to enter into the drum 40. Also, the drum 40 includes apertures 45 in the cylindrical sidewall 82. The heated air exits the drum 40 through gap G as illustrated in FIG. 2. An outlet 48 of the tub 42 enables exit of the air. Piping or conduit 66 connects with outlet 48 to exit the air, via a blower or fan 68, to an exhaust tube 70. Thus, the used air is exhausted from the combination washer/dryer machine 20. The exhaust tube 70 is connected with piping in the building to exit the air to ambient.

A gap 80 is formed between the drum 40 and the tub 42. The gap 80 provides for the recovery of water or the like between the drum 40 and the tub 42. The drum 40 has a cylindrical sidewall 82 and an end plate surface 84. Likewise, the tub 42 has a cylindrical wall 86 and an end wall 88. The external surface of the sidewall 82 and end wall 88 face an inner surface of the tub 42.

A seal 90 may be connected to the drum 40 or the tub 42. The seal 90 includes an attachment portion 92 and a dynamic flap 94. The attachment portion 92 may secure to the drum 40 or the tub 42. The flap 94 is manufactured from a desired material to enable the flap to deflect as needed at various RPM speeds of the drum. This enables the appropriate gap for the washing/drying operation.

Turning to FIG. 4A, the flap is illustrated at a first height with the drum in a non-rotating position of 0 RPM. FIG. 4B illustrates the seal flap 34 deflection at a drum rotation speed of about 55 RPM. This closes the gap and enables approximately less than 20% of the air to bypass around the drum 40. The speed during drying of the clothes within the drum is about 55 RPM.

FIG. 4C illustrates the flap 94 deflected even further at a drum RPM speed of approximately 1160. This is during the washing cycle to enable a larger gap to be present when the combination washer/dryer machine is in a washing mode.

Turning to FIGS. 5-7, an additional embodiment is illustrated. Here, the seal 90 includes an attachment portion 92 and a flap 94. The attachment portion 92 is secured to the tub 42 via rivets or the like. The seal 90 in FIG. 5 is in a rest position of the drum 40. FIG. 6 illustrates the seal 90 in a washing mode with the flap 94 in a default position. As seen in FIG. 6, the flap as well as the attachment portion are positioned against the tub 42 enabling the gap between the drum 40 and tub 42.

FIG. 7 illustrates the seal 90 in a drying operation. Here, the air flowing out of the tub 42 into the drum 40 forces the flap 94 towards the drum 40. This movement of the dynamic flap 94 by the drying air flow closes the gap between the tub 42 and the drum 40.

FIGS. 8 and 9 illustrate an additional embodiment. Here, the seal 90 is like that of FIGS. 5-7, however the attachment portion 92 and flap 94 are positioned in a different angular direction. However as illustrated in the rest position in FIG. 8, the flap 94 is moved down on the tub 42 during the washing operation. FIG. 9 illustrates the flap 94 when drying air is formed into the tub 42 and then into the drum 40. Here, the flap 94 closes the gap as illustrated.

Turning to FIGS. 10, 11 and 12, an additional embodiment is illustrated. Here the tub 42 includes a ring 100 positioned about the drum. The ring 100 includes a plurality of ring apertures 102 that enable the heating air to exit the ring. Thus, as heating air is passed into the ring 100, it passes through the ring apertures 102. A seal 110 is positioned over the ring 100. The seal 110 includes a securement portion 112 and a flap portion 114. The securement portion 112 is fitted about the circumferential surfaces of the ring 100 so that the flap 114 can cover the ring apertures 102. In FIG. 11, the seal 110 is illustrated in the drum 40 at a 0 RPM position. The flap 114 moves to cover and seal the ring apertures 102 as the washing cycle is initiated. FIG. 12 illustrates the flap 114 moving away from the ring 100 during the drying cycle. As air enters the ring apertures 102, the flap 114 is moved toward the drum 40 to close the gap.

Turning to FIG. 13, an additional embodiment is illustrated. Here, the seal 120 is positioned on the tub 42. The seal 120 includes a channel 122 that directs the air flow around the drum to provide a labyrinth seal. Here, the seal 120 includes a first step portion 124, a second step portion 126 and a third step portion 128. The second step portion 126 is at a smaller height than the other two and is positioned adjacent to the edge of the drum 40. The first and third steps 124, 128 have a larger height such that they project closer to the drum 40. Thus, the first, second and third steps 124, 126, 128 form the channel 122 that provides for the labyrinth flow of air passing around the seal 120.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A combination washer/dryer machine, comprising:
a cabinet;
a tub positioned inside the cabinet, the tub having an inner surface;
a drum that is rotatable inside the tub, the drum has an external surface; and
a ring positioned on the inner surface of the tub; and
a seal positioned on the ring such that a gap is formed between the seal and the drum washing operations,
wherein the seal is configured to provide a flow restriction through the gap that minimizes drying air from bypassing the drum during drying operations,
wherein the ring includes a plurality of apertures that are covered by a seal during washing operations and wherein the seal is moveable away from the ring during drying operations to enable the drying air to pass through the apertures in the ring and to direct the drying air passing through the apertures into the drum.

2. The combination washer/dryer machine of claim 1, wherein the drying air passing through the apertures in the ring during the drying operation moves the seal towards the drum to reduce the gap between the seal and the drum.

3. The combination washer/dryer machine of claim 1, wherein the seal is dynamic and is manufactured from a resilient material.

4. The combination washer/dryer machine of claim 1, wherein the seal is configured to be moveable in response to drying air flow.

5. The combination washer/dryer machine of claim 1, wherein the tub has a cylindrical wall and an end wall, wherein the drum has a cylindrical sidewall and an end plate surface, and wherein the seal is positioned between the end wall of the tub and the end plate surface of the drum.

6. The combination washer/dryer machine of claim 5, wherein the seal includes an attachment portion and a flap portion.

7. The combination washer/dryer machine of claim 6, wherein the attachment portion mounts to the tub.

8. The combination washer/dryer machine of claim 6, wherein the flap portion is dynamic and is manufactured from a resilient material.

9. The combination washer/dryer machine of claim 6, wherein the flap portion is configured to be moveable in response to drying air flow.

10. A combination washer/dryer machine, comprising:
a cabinet;
a tub is positioned inside the cabinet;
a rotatable drum inside the tub;

a ring mounted to the tub and positioned between an inner surface of the tub and an external surface of the drum; and a seal positioned on the ring, the seal including a flap extending towards the drum, wherein the flap provide gap between the seal and the drum during washing operations, wherein the ring Includes a plurality of apertures that are circumferentially spaced about the ring, wherein the flap is configured to cover the apertures in the ring during washing operations, wherein the drying air passes through the apertures in the ring during drying operations, moving the flap towards the drum to reduce the gap between the seal and the drum and block the drying air from bypassing the drum.

11. The combination washer/dryer machine of claim 10, wherein the flap is moveable in response to drying air flow passing through the tub and into the drum.

12. A laundry machine, comprising:

a cabinet;

a tub positioned inside the cabinet, the tub having an inner surface;

a drum that is rotatable inside the tub, the drum has an external surface; and a ring positioned on the inner surface of the tub; and a flap positioned on the ring that extends towards the drum, wherein the flap is mover tween a first position during washing operations where there is a gap between the flap and the drum and a second position during drying operations where the gap is reduced or eliminated to minimize bypass of drying air around the drum, wherein the flap is manufactured from a resilient material, wherein the ring includes a plurality of apertures, wherein the flap is positioned to cover the apertures in the ring in the first position and deflects away from the ring in the second position as heated drying air flows through the apertures in the ring during drying operations.

13. The laundry machine of claim 12, wherein the tub has a cylindrical wall and an end wall, wherein the drum has a cylindrical sidewall and an end plate surface, and wherein the ring is positioned on the end wall of the tub such that the flap deflects towards the end plate surface of the drum when the flap moves from the first position to the second position.

* * * * *